US006119420A

United States Patent [19]

Koenig, Jr. et al.

[11] Patent Number: 6,119,420

[45] Date of Patent: Sep. 19, 2000

[54] DRYWALL-TRIMMING STRIP FOR TRIMMING ARCHWAY

[75] Inventors: Joseph M. Koenig, Jr., Lincolnwood; Mark Budzik, Niles, both of Ill.

[73] Assignee: Trim-Tex, Inc., Lincolnwood, Ill.

[21] Appl. No.: 09/298,129

[22] Filed: Apr. 23, 1999

[51] Int. Cl.[7] ..... E04F 13/06

[52] U.S. Cl. ..... 52/255; 52/85; 52/717.03; 52/717.05

[58] Field of Search ..... 52/717.01, 717.03, 52/717.04, 717.05, 255, 256, 257, 85, 86, 87, 371, 287.1, 288.1

[56] References Cited

U.S. PATENT DOCUMENTS

| | | | |
|---|---|---|---|
| 1,988,739 | 1/1935 | Jones | 52/85 |
| 2,311,345 | 2/1943 | Mitchell | 52/255 |
| 3,008,273 | 11/1961 | Widin | 52/85 |
| 4,863,774 | 9/1989 | Tucker | 52/371 X |
| 5,048,247 | 9/1991 | Weldy | 52/255 |
| 5,313,755 | 5/1994 | Koenig, Jr. | 52/255 |
| 5,442,886 | 8/1995 | Iacobelli | 52/255 |
| 5,671,583 | 9/1997 | Turner | 52/85 X |
| 5,752,353 | 5/1998 | Koenig et al. | 52/255 |
| 5,816,002 | 10/1998 | Bifano et al. | 52/255 |

FOREIGN PATENT DOCUMENTS

| | | | |
|---|---|---|---|
| 529032 | 11/1940 | United Kingdom | 52/255 |
| 1509966 | 5/1978 | United Kingdom | 52/287.1 |

OTHER PUBLICATIONS

Trim–Tex, Inc. Rigid Vinyl Drywall Accessories 1997–98 Catalog.

*Primary Examiner*—Laura Callo
*Attorney, Agent, or Firm*—Rockey, Milnamow & Katz, Ltd.

[57] ABSTRACT

For trimming an archway, a drywall-trimming has a nose with an outer surface and an inner surface. The outer surface has a curved portion conforming substantially to an arcuate profile with a radius in a range from approximately ¼ inch to approximately ¾ inch. The drywall-trimming strip has a series of slits defining a series of tabs spaced from one another along a tabbed edge but not extending into the nose. Near the tabbed edge, the slits have widened, oblong portions. Usually, the drywall-trimming strip has a flange extending from and along an opposite edge, but the flange is omitted for some applications. A comparatively softer portion, which includes the juncture where the tabs are joined to the tabbed edge, is made from a comparatively softer, more flexible, polymeric material, such as polyvinyl chloride having a hardness of Durometer 92 Shore A. A comparatively harder portion, which includes the flange and at least a substantial portion of the nose along the flanged edge, is made from a comparatively harder, less flexible, polymeric material, such as polyvinyl chloride having a hardness of Durometer Shore 82 D.

23 Claims, 3 Drawing Sheets

DRYWALL-TRIMMING STRIP FOR TRIMMING ARCHWAY

TECHNICAL FIELD OF THE INVENTION

This invention pertains to a drywall-trimming strip, which has a nose and a series of tabs spaced from one another along a tabbed edge of the nose, whereby the drywall-trimming strip is curvable so as to conform to an archway, and which is improved by this invention, whereby an outer surface of the nose tends to continue to conform substantially to an arcuate profile even after the drywall-trimming strip has been curved so as to conform to an archway.

BACKGROUND OF THE INVENTION

As used for trimming an archway around a doorway or around a window, a drywall-triming strip as known heretofore is extruded from a substantially rigid, polymeric material, such as polyvinyl chloride, so as to have a nose with a tabbed edge and an opposite edge, a series of slits defining a series of tabs, which are spaced from one another along the tabbed edge. Usually, the drywall-trimming strip has a flange extending from the opposite edge.

For most applications, the drywall-trimming strip is curved so that so that the tabs are splayed outwardly, so that the tabs can be suitably tacked (e.g adhesively or via staples) to a drywall panel defining one side of an archway, and so that the flange is curved so as to conform to the archway. The tabs are punched so as to have multiple holes or multiple slits. For many applications, in which the flange overlies a drywall panel that has been curved, the flange is punched similarly and tacked similarly. For some applications, in which a flange is provided, the flange is not punched.

After the tabs have been tacked, along with the flange if the flange is punched and tacked, drywall-finishing material (so-called drywall compound) is applied over the tabs, and over the flange if the flange is punched and tacked, and is pressed through the punched holes or punched slits. When pressed through the punched holes or punched slits, drywall-finishing material adheres to the drywall panels underlying the drywall-trimming strip, so as to affix the drywall-finishing strip permanently to the underlying panels.

Usually, when the drywall-trimming strip is unstressed, an outer surface of the nose conforms substantially to an arcuate profile. Commonly, if the outer surface of the nose conforms substantially to an arcuate profile having a radius larger than approximately one-half inch, the drywall-trimming strip is known as a "bullnose" archway corner bead. In a "bullnose" archway corner bead as known heretofore, it has always been the practice for the tab-defining slits to extend into the nose, approximately to or slightly past an imaginary midline along the outer surface of the nose.

When a "bullnose" archway corner bead is installed, portions of the slits remain exposed where the slits extend into the nose. The exposed portions of the slits must be then filled with drywall-finishing material and the filled portions must be then sanded, so as to provide the nose with a smooth, outer surface, which is suitable for painting. Filling the exposed portions of the slits with drywall-finishing material and sanding the filled portions are painstaking tasks.

A need has been ascertained, to which this invention is addressed, to provide a drywall-trimming strip resembling a "bullnose" archway corner bead, having a nose with an outer surface conforming substantially to an arcuate profile, particularly but not exclusively an arcuate profile having a radius in a range from approximately ¼ inch to approximately ¾ inch, and useful for trimming an archway without any necessity for the filling and sanding tasks discussed above.

SUMMARY OF THE INVENTION

This invention provides a drywall-trimming strip, which is curvable so as to conform to an archway, such as an archway around a doorway or around a window and which does not necessitate the filling and sanding tasks discussed above.

Broadly, the drywall-trimming strip has a nose with an outer surface and an inner surface and with a tabbed edge and an opposite edge. The outer surface conforms substantially to an arcuate profile, which preferably has a radius a range from approximately ¼ inch to approximately ¾ inch. A series of slits define a series of tabs, which are spaced from one another along the tabbed edge. The tabs are joined to the tabbed edge at a juncture, which extends along the tabbed edge, between the tabbed edge and the slits defining the tabs.

This invention contemplates that the slits do not extend into the nose. This invention contemplates that if the nose has an outer surface having an arcuate profile having an outer radius that is small, preferably in a range from approximately ¼ inch to approximately 17/32 inch, the slits may have oblong portions, which are widened in a direction that is parallel to the tabbed edge when the drywall-trimming strip is not stressed, whereupon the drywall-trimming strip may be then made in its entirety from a uniform material, preferably a substantially rigid, polymeric material, such as polyvinyl chloride of a hardness of Durometer 82 Shore D.

Preferably, the drywall-trimming strip has a comparatively softer portion, which includes the juncture where the tabs are joined to the tabbed edge of the nose, and a comparatively harder portion, which includes at least a substantial portion of the nose along the opposite edge. Preferably, the profile of the drywall-trimming strip is co-extruded from a comparatively softer, more flexible, polymeric material, such as polyvinyl chloride of a hardness in a range from Durometer 80 Shore A to Durometer 95 Shore A, and from a comparatively harder, less flexible, polymeric material, such as polyvinyl chloride of a hardness in a range from Durometer 65 Shore D to Durometer 85 Shore D, whereupon the tabs and the flange, if included, are punched so as to have holes or slits.

Preferably, the comparatively harder portion includes at least substantially all of the nose, except for the juncture, which extends along the tabbed edge of the nose, between the tabbed edge of the nose and the slits defining the tabs. Alternatively, the juncture extends along the tabbed edge of the nose and includes a portion of the nose.

Preferably, substantially all of the tabs are made from the comparatively harder material. Alternatively, the comparatively softer portion includes the entire tabs, as well as the juncture extending between the tabbed edge and the slits defining the tabs.

For most but not all applications, the drywall-trimming strip has a flange extending from the opposite edge, which may be then called a flanged edge. Preferably, if a flange is provided, the flange is made from the comparatively harder material.

These and other objects, features, and advantages of this invention are evident from the following description of several contemplated embodiments of this invention, as illustrated in the accompanying drawings.

DETAILED DESCRIPTION OF THE ILLUSTRATED EMBODIMENTS

Figure 1:
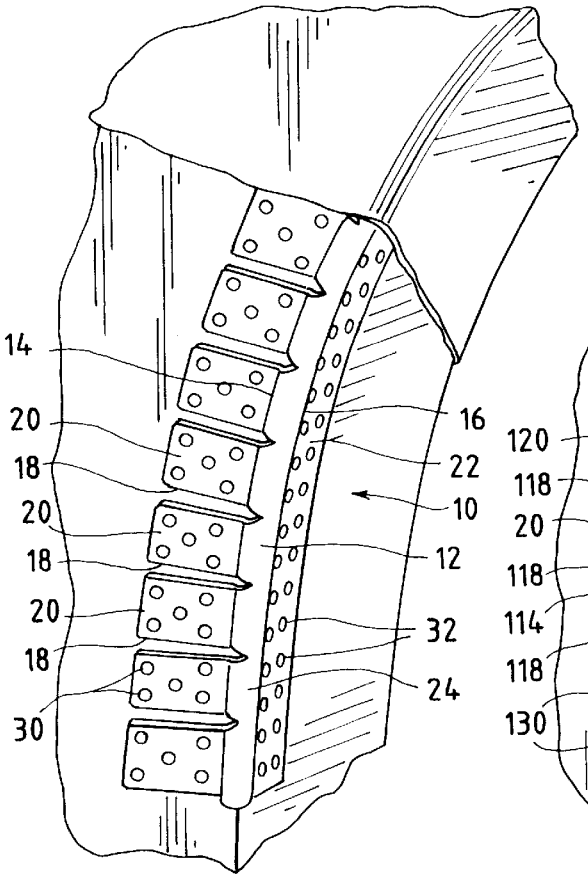
FIG. 1 PRIOR ART
FIG. 1 is a fragmentary, perspective view of a bullnose archway bead exemplifying prior art.

As shown in FIG. 1, a bullnose archway bead 10 similar to products available commercially from Trim-Tex, Inc. of Lincolnwood, Ill. under the trade designation "BULLNOSE ARCHWAY CORNER BEAD" is extruded as a straight piece from substantially rigid material, such as polyvinyl chloride having a hardness of Durometer 82 Shore D, so as to have a nose 12 with a tabbed edge 14 and a flanged edge 16, a series of slits 18 defining a series of tabs 20, which are spaced from one another along the tabbed edge 14, and a flange 22, which extends from and along the flanged edge 16.

The nose 12 has an outer surface 24, which conforms substantially to an arcuate profile when the drywall-trimming strip 10 is unstressed. The slits 18 extend into the nose 12, approximately to an imaginary midline extending along the outer surface 24 of the nose 12 and dividing the outer surface 24 of the nose 12 into two equal portions. The tabs 20 are punched so as to have multiple holes 30 and the flange 22 is punched so as to have multiple holes 32.

When the bullnose archway bead 10 is installed, the bullnose archway bead 10 is curved so that the tabs 20 are splayed outwardly, as illustrated in FIG. 1, so that the tabs 20 can be suitably tacked (e.g. adhesively or via staples) to a drywall panel defining an archway, and so that the flange 22 is curved so as to conform to the archway. Drywall-finishing material (so-called drywall compound) is applied over the tabs 20, and over the flange 22, and is pressed through the punched holes 30, 32. When pressed through the punched holes 30, 32, drywall-finishing material adheres to the drywall panels underlying the bullnose archway bead 10, so as to affix the bullnose archway bead 10 permanently to the underlying panels.

Because the slits 18 extend into the nose 12, approximately to the imaginary midline, portions of the slits 18 remain exposed. The exposed portions of the slits 18 must be then filled with drywall-finishing material and the filled portions must be then sanded, so as to provide the nose 12 with a smooth, outer surface 24, which is suitable for painting. Filling the exposed portions of the slits 18 with drywall-finishing material and sanding the filled portions are painstaking tasks.

Figure 2:
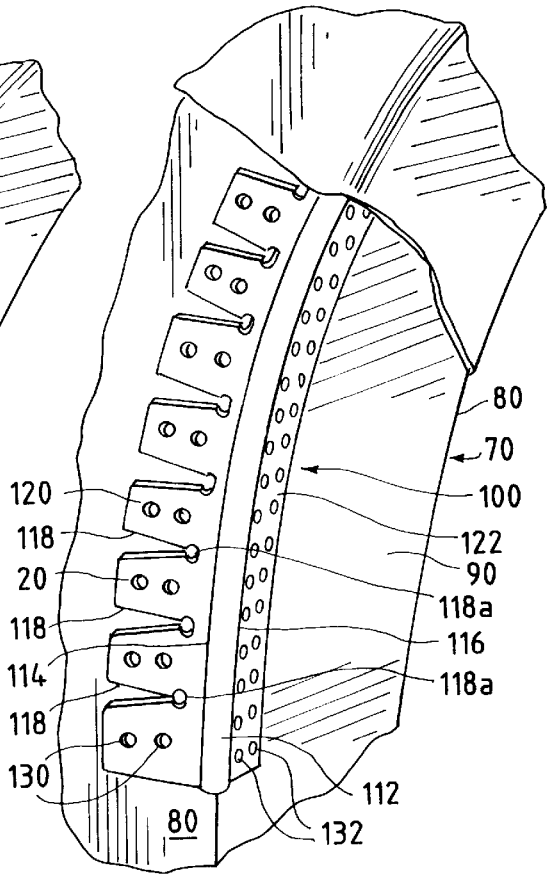
FIG. 2, on a smaller scale, is a fragmentary, perspective view of an archway defined by drywall panels and trimmed with a drywall-trimming strip, which constitutes one contemplated embodiment of this invention.

As shown in FIG. 2, a drywall-trimming strip 100 constituting one contemplated embodiment of this invention is useful for triming an archway 70, such as an archway around a doorway or around a window, without any necessity for the filling and sanding steps discussed above. The drywall-trimming strip 100 may embody any of the several constructions illustrated in FIGS. 3, 4, and 5.

The archway 70 is defined by two drywall panels 80, one defining each side of the archway 70, and by a drywall strip 90 extending between the drywall panels 80 and being curved so as to define an inside curvature of the archway 70. One of the drywall panels 80 is not shown. The drywall strip 90 is formed from a drywall panel, in a known manner, by cutting, steaming, and bending.

The drywall-trimming strip 100 is co-extruded as a straight piece from a comparatively softer, more flexible, polymeric material, such as polyvinyl chloride having a hardness of Durometer 92 Shore A, and from a comparatively harder, less flexible, polymeric material, such as polyvinyl chloride having a hardness of Durometer 82 Shore D, so as to have a nose 112 with a tabbed edge 114 and a flanged edge 116, a series of slits 118 defining a series of tabs 120, which are spaced from one another along the tabbed edge 114, and a flange 122, which extends from and along the flanged edge 116. Near the tabbed edge 114, each slit 118 has an oblong portion 118*a*, which is 25 widened, as compared to other portions of such slit 118, and which extends in a direction parallel to the tabbed edge 114 when the drywall-trimming strip 100 is unstressed. As illustrated, the slits 118 do not extend past the tabbed edge 114, into the nose 112.

The nose 112 has an outer surface 124 and an inner surface 126. When the drywall-trimming strip 100 is unstressed, the outer surface 124 conforms substantially to an arcuate profile with a comparatively larger radius, in a range from approximately ¼ inch to approximately ¾ inch, and the inner surface 126 conforms to an arcuate profile having a comparatively smaller radius. The tabs 120 are punched so as to have multiple holes 130 and the flange 122 is punched so as to have multiple holes 132.

Figure 3:
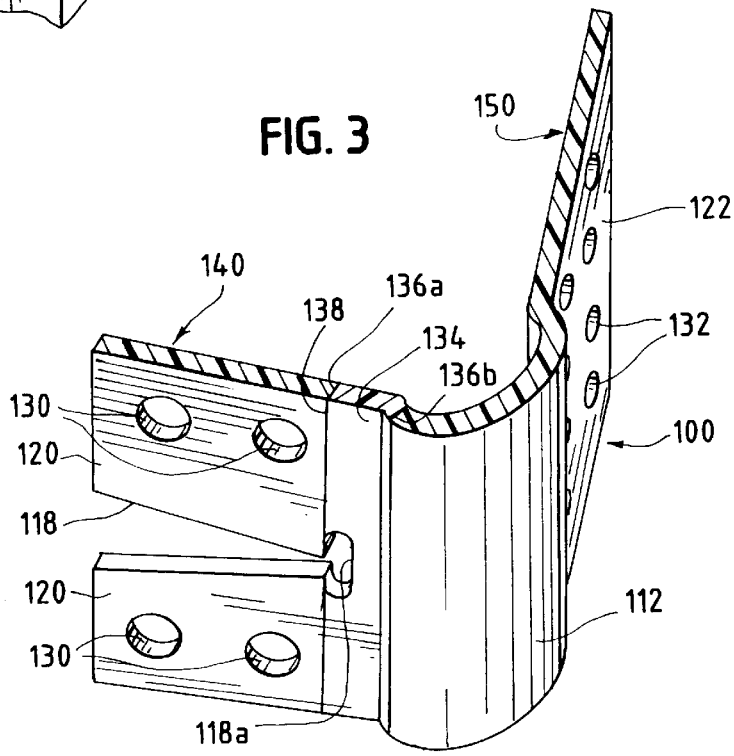
FIG. 3 is a greatly enlarged, cross-section of a preferred construction of the drywall-trimming strip illustrated in FIG. 2.

In the preferred construction illustrated in FIG. 3, the comparatively softer, more flexible, polymeric material is used only to make the juncture 134, which extends along the tabbed edge 114, between the tabbed edge 114 and the slits 118 defining the tabs 120, whereas the nose 112, the flange 122, and substantially all of the tabs 120 are made from the comparatively harder, less flexible, polymeric material. The material interfaces 136*a*, 136*b*, between the juncture 134, which includes the oblong portions 118*a* of the slits 118, and the other portions of the tabs 120 are demarcated in FIG. 3. The profile of the drywall-trimming strip 100 is co-extruded from the respective materials, whereupon the slits 118 defining the tabs 120 are formed and whereupon the tabs 120 and the flange 122 are punched.

Figure 4:
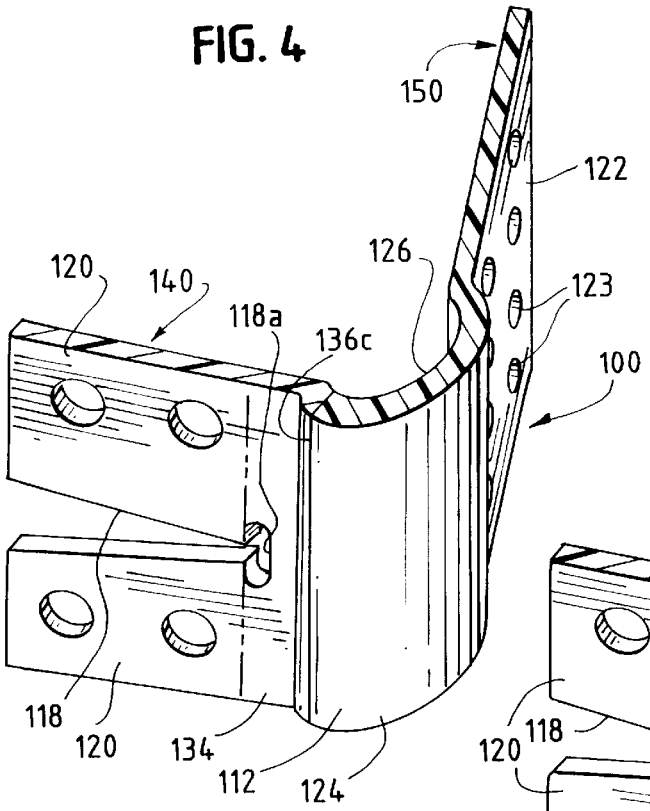
FIGS. 4, 5, and 6 are similarly enlarged, cross-sections, each of an alternative construction of the drywall-trimming strip illustrated in FIG. 2.

In the alternative construction illustrated in FIG. 4, a comparatively softer portion 140 of the drywall-trimming strip 100 is made from the comparatively softer, more flexible, polymeric material and is comprised of the tabs 120 and of the juncture 134 extending between the tabbed edge 114 and the slits 118 defining the tabs 120. The material interface 136c between the juncture 134, which includes the oblong portions 118*a* of the slits 118, and the nose 112 is demarcated in FIG. 4, in which a dashed line 136*d* demarcates an arbitrary boundary of the juncture 134. Moreover, a comparatively harder portion 150 of the drywall-trimming strip 100 is made from the comparatively harder, less flexible, polymeric material and is comprised of the nose 112 and the flange 122.

Figure 5:
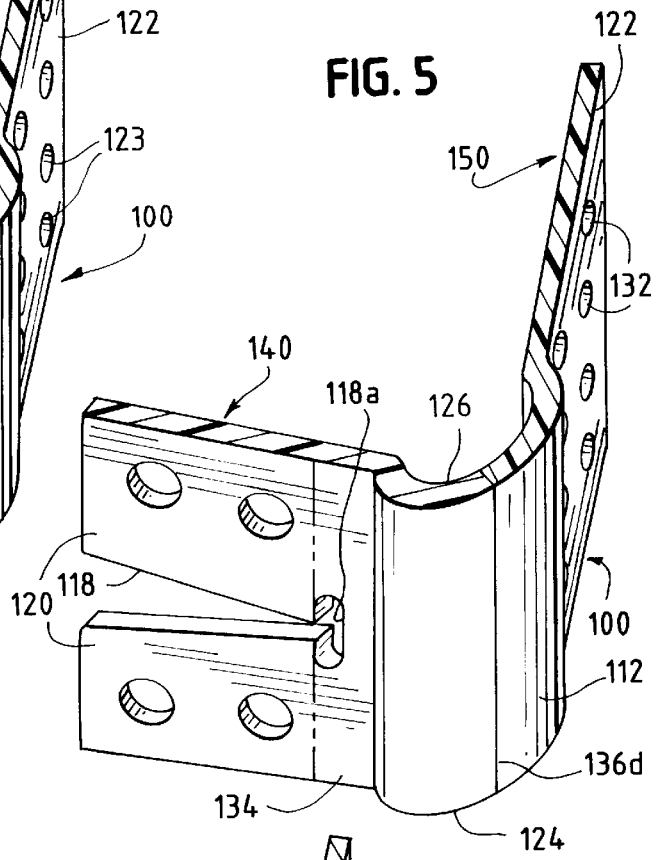

In the alternative construction illustrated in FIG. 5, the comparatively softer portion 140 is comprised not only of the tabs 120 and the juncture 134 but also of an adjacent portion 142 of the nose 112. The respective portions of the nose 112 that are made from the comparatively harder and comparatively softer materials meet at a material interface 136*d* dividing the nose 112 into substantially equal portions.

Figure 6:
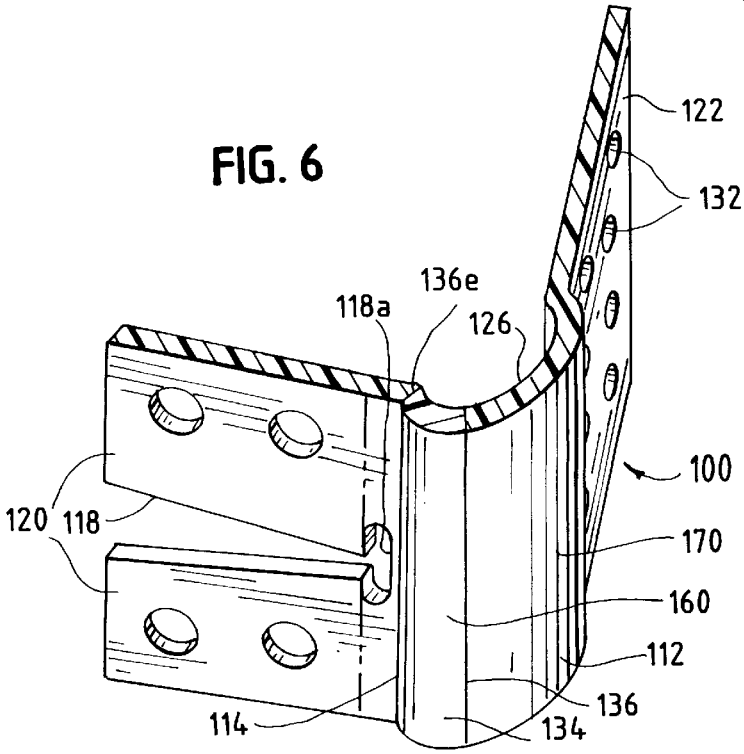

In the alternative construction illustrated in FIG. 6, the juncture 134 extends along the tabbed edge 114, is comprised of a minor portion 160 of the nose 112, and is made of the comparatively softer, more flexible, polymeric material, whereas a major portion 170 of the nose 112 and the tabs 120 are made from the comparatively harder, less flexible, polymeric material. Material interfaces 136*e*, 136*f*, between the juncture 134 and the other portions of the drywall-trimming strip 100 are demarcated in FIG. 6.

Figure 7:
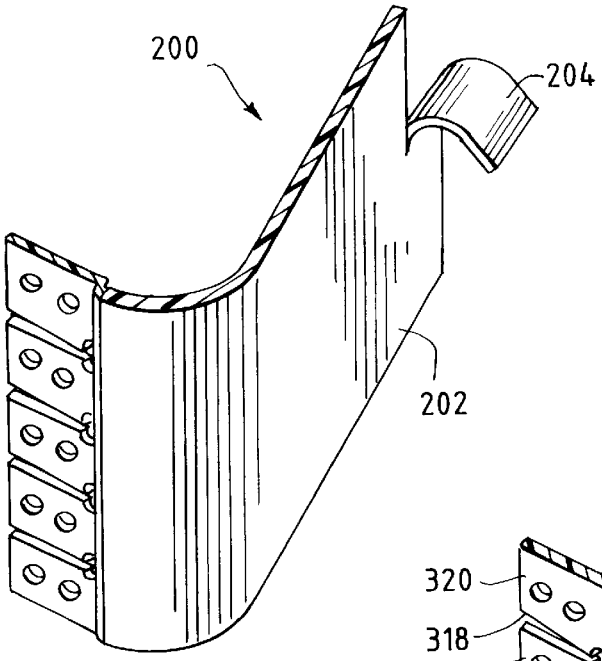
FIG. 7, on a larger scale compared to FIG. 2, is a fragmentary, perspective view of a drywall-trimming strip, which constitutes another contemplated embodiment of this invention.

As illustrated in FIG. 7, a drywall-trimming strip 200 constituting another contemplated embodiment of this invention is useful where drywall-trimming strips available commercially from Trim-Tex, Inc. of Lincolnwood, Ill. under the trade designation "BULLNOSE ARCHWAY L BEAD" are useful, for trimming an archway around a window. The drywall-trimming strip 200 is similar to the drywall-trimming strip 100 of any of the constructions illustrated in FIGS. 3, 4, 5, and 6, except that the drywall-trimming strip 200 has a flange 202, which is several times longer than the flange 122 of the drywall-trimming strip 100 and which is not punched. The flange 202 may be pre-scored along parallel lines, in a known manner, so that a strip 204 can be readily torn from the flange 202 to shorten the flange 202 to a desired length for a given application.

Figure 8:
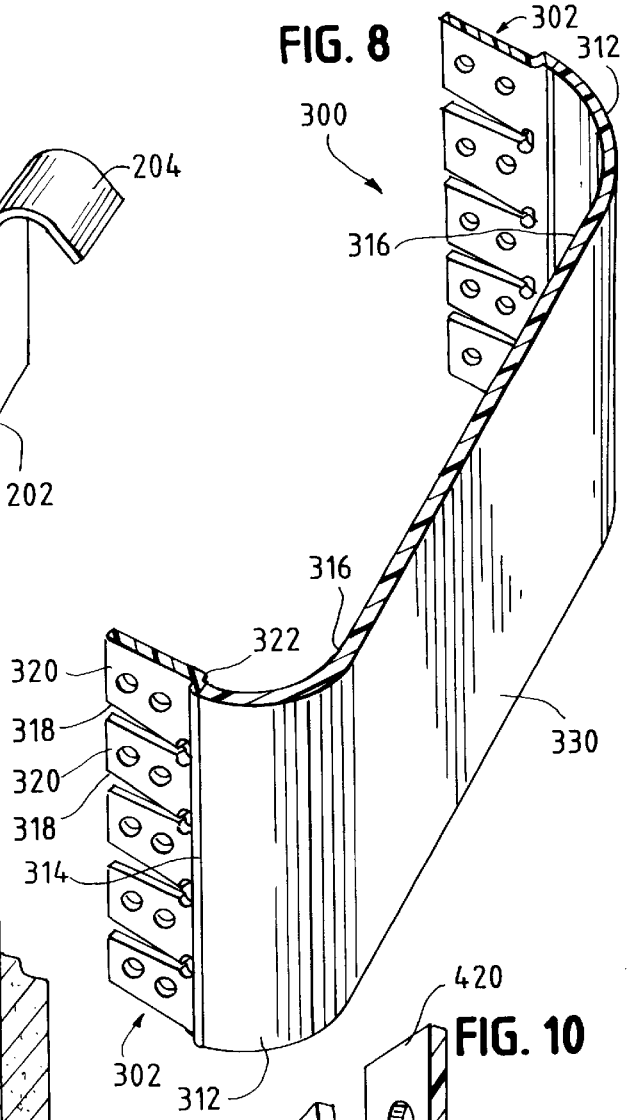
FIG. 8, on a scale similar to the scale of FIG. 7, is a fragmentary, perspective view of a drywall-trimming strip, which constitutes yet another contemplated embodiment of this invention.

As illustrated in FIG. 8, a drywall-trimming strip 300 constituting another contemplated embodiment of this invention is useful where drywall-trimming strips available commercially from Trim-Tex, Inc. of Lincolnwood, Ill. under the trade designation "BULLNOSE ARCHWAY FAST CAP" are useful, for trimming both sides of an archway around a doorway between two rooms. At each of its opposite sides 302, the drywall-trimming strip 300 has a nose 312, a series of slits 318 defining a series of tabs 320, and a juncture 322 extending along a tabbed edge 314 of the nose 312, between the tabbed edge 314 and the slits 318 defining the tabs 120. The drywall-trimming strip 300 has a panel 330 extending between the opposite edges 316 of the noses 312. The opposite edges 316 are demarcated arbitrarily in FIG. 8.

When the drywall-trimming strip 300 is installed, the panel 330 is curved to conform to the archway. Because the panel 300 extends between the opposite sides of the archway, there is no need for a drywall strip corresponding to the drywall strip 90 illustrated in FIG. 2 and discussed above. It is convenient herein to regard the panel 300 as a flange extending from the opposite edge 316 of each nose 312. The nose, slits, tabs, and juncture at each side 302 of the drywall-trimming strip 300 are similar to the nose, slits, tabs, and juncture of the drywall-trimming strip 100 of any of the constructions illustrated in FIGS. 3, 4, 5, and 6.

Figure 9:
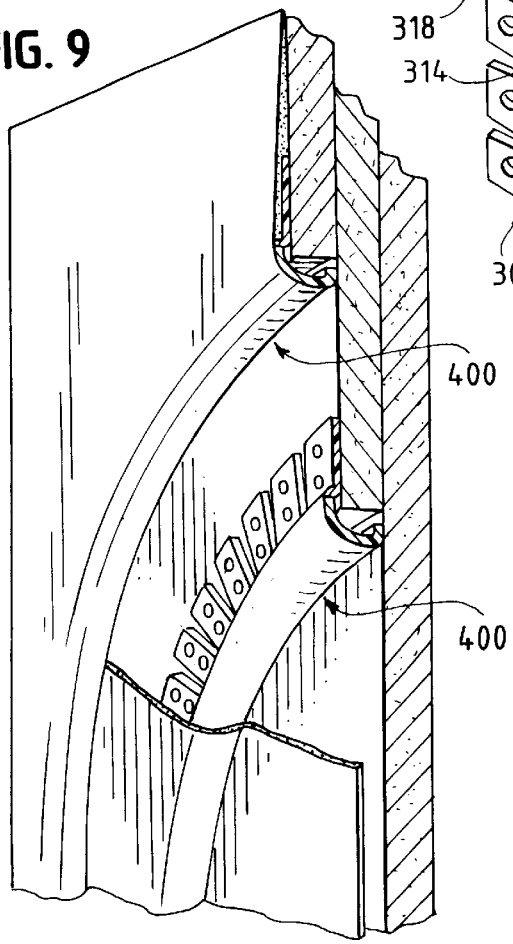
FIG. 9 is a fragmentary, perspective view of a multi-step archway defined by drywall panels and trimmed at each of two steps by a drywall-trimming strip, which constitutes still another contemplated embodiment of this invention.
Figure 10:
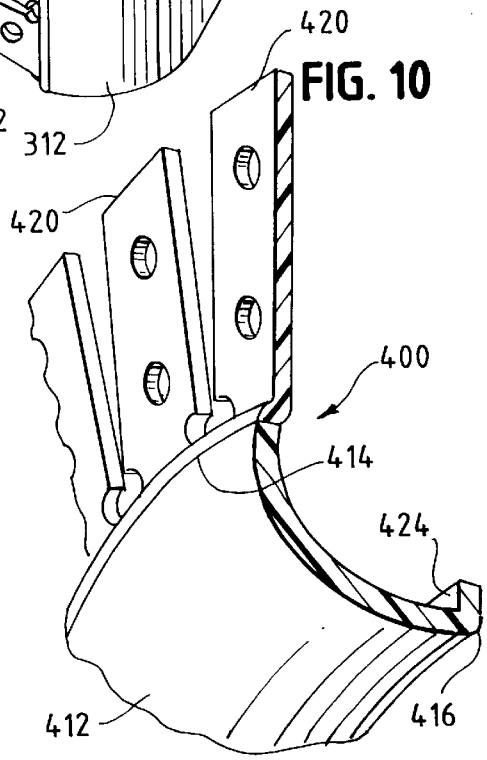
FIG. 10, on a scale similar to the scale of FIGS. 4, 5, and 6, is a cross-section of an exemplary one of the drywall-trimming strips illustrated in FIG. 8.

As illustrated in FIGS. 9 and 10, a drywall-trimming strip 400 constituting another contemplated embodiment of this invention is useful for trimming a multi-step archway. In FIG. 8, two such strips 400 are illustrated, each trimming one of two steps. As illustrated in FIG. 9, the drywall-trimming strip 400 is similar to the drywall-trimming strip 100 of any of the constructions illustrated in FIGS. 3, 4, 5, and 6, except that the drywall-trimming strip 400 does not have a flange corresponding the flange 124 of the drywall-trimming strip 100. The drywall-trimming strip 400 has similar tabs 420 at the tabbed edge 414 of its nose 412. The drywall-trimming strip 400 differs from the drywall-trimming strip 100 in that the drywall-trimming strip 400 has a return flange 424, which extends along the opposite edge 416 of its nose 412, which resists buckling of the nose 412, and which projects for a short distance (no farther than approximately ¼ inch) so that the return flange 424 is curvable when the drywall-trimming strip 400 is installed.

When a drywall-trimming strip conforming to any of the disclosed embodiments is installed, the juncture extending between the tabbed edge of the nose and the slits defining the tabs can stretch, whereby the outer surface of the nose can continue to conform substantially to an arcuate profile even when the drywall-trimming strip is curved so as to conform to an archway. Because the slits defining the tabs do not extend beyond the tabbed edge, into the nose, the slits do not have exposed portions that would require the filling and sanding steps discussed above.

In each of the disclosed embodiments, the radius of the arcuate profile of the outer surface of the nose limits how tightly the drywall-trimming strip can curve without buckling, a smaller radius permitting the drywall-trimming strip to be more tightly curved without buckling. Each of the disclosed embodiments is useful for trimming doorways of conventional widths (e.g. 30 to 36 inches) and windows of comparable widths if the arcuate profile of the outer surface of the nose is in a range from approximately ¼ inch to approximately ¾ inch. Further, each of the disclosed embodiments may prove to have other uses if the arcuate profile of the outer surface of the nose is larger or smaller, as compared to that range. A larger radius is useful for trimming an archway larger than a standard doorway or a comparable window.

What is claimed is:

1. For trimming an archway, a drywall-triming strip having a nose with an outer surface and an inner surface and with a tabbed edge and an opposite edge, the outer surface conforming substantially to an arcuate profile, the drywall-trimming strip having a series of slits, which define a series of tabs spaced from one another along the tabbed edge but which do not extend into the nose, the tabs being joined to the tabbed edge of the nose at a juncture, the drywall-trimming strip having a more flexible portion, which includes the juncture, the drywall-trimming strip having a less flexible portion, which includes at least a substantial portion of the nose along the opposite edge, the more flexible portion being comparatively softer and the less flexible portion being comparatively harder, in Shore Durometer values.

2. The drywall-trimming strip of claim 1 wherein the comparatively harder portion includes at least substantially all of the nose.

3. The drywall-trimming strip of claim 1 wherein each of the comparatively harder and comparatively softer portions includes a substantially equal portion of the nose.

4. The drywall-trimming strip of claim 1 wherein the comparatively softer portion includes the entire tabs.

5. The drywall-trimming strip of claim 1 wherein the comparatively softer portion is comprised of the juncture.

6. The drywall-trimming strip of any one claims 1 through 5 wherein the outer surface conforms substantially to an arcuate profile having a radius in a range from approximately ¼ inch to approximately ¾ inch.

7. For trimming an archway, a drywall-trimming strip having a nose with an outer surface and an inner surface and with a tabbed edge and a flanged edge, the outer surface conforming substantially to an arcuate profile with a comparatively larger radius and the inner surface conforming substantially to an arcuate profile with a comparatively smaller radius, the drywall-trimming strip having a series of slits, which define a series of tabs spaced from one another along the tabbed edge but which do not extend into the nose, the tabs being joined to the tabbed edge of the nose at a juncture extending along the tabbed edge, the juncture extending between the tabbed edge and the slits defining the tabs, the drywall-trimming strip having a flange extending from and along the flanged edge, the drywall-trimming strip having a comparatively softer portion, which includes the juncture where the tabs are joined to the tabbed edge of the nose, the drywall-trimming strip having a comparatively harder portion, which includes the flange and at least a substantial portion of the nose along the flanged edge, wherein comparatively softer and comparatively harder are defined by Shore Durometer values.

8. The drywall-trimming strip of claim 7 wherein the comparatively harder portion includes the flange and at least substantially all of the nose.

9. The drywall-trimming strip of claim 7 wherein the comparatively harder portion includes the flange and wherein each of the comparatively harder and comparatively softer portions includes a substantially equal portion of the nose.

10. The drywall-trimming strip of claim 7 wherein the comparatively softer portion includes the entire tabs.

11. The drywall-trimming strip of claim 7 wherein the comparatively softer portion is comprised of the juncture.

12. The drywall-trimming strip of any one claims 7 through 11 wherein the outer surface conforms substantially to an arcuate profile having a radius in a range from approximately ¼ inch to approximately ¾ inch.

13. A drywall-trimming strip, which is curvable so as to conform to an archway, the drywall-trimming strip having, at each side of the drywall-trimming strip, a nose with an outer surface and an inner surface and with a tabbed edge and an opposite edge, the outer surface conforming substantially to an arcuate profile, the drywall-trimming having a series of slits defining a series of tabs spaced from one another along the tabbed edge, the tabs being joined to the tabbed edge of the nose at a juncture, the drywall-trimming strip having a panel extending between and along the opposite edges of the noses, the drywall-trimming strip having comparatively softer portions, which include the junctures, the drywall-trimming strip having a comparatively harder portion, which includes the panel and at least a substantial portion of each nose along the opposite edge of said nose, wherein comparatively softer and comparatively harder are defined by Shore Durometer values.

14. The drywall-trimming strip of claim 13 wherein the outer surface conforms substantially to an arcuate profile having a radius in a range from approximately ¼ inch to approximately ¾ inch.

15. For trimming an archway a drywall-trimming strip having a nose with an outer surface and an inner surface and with a tabbed edge and an opposite edge, the outer surface conforming substantially to an arcuate profile, the drywall-trimming strip having a series of slits, which define a series of tabs spaced from one another along the tabbed edge but which do not extend into the nose, the slits having oblong portions near the tabbed edge, the oblong portions being widened, as compared to other portions of the slits, in a direction that is parallel to the tabbed edge when the drywall-trimming strip is not stressed, the drywall-trimming strip having more flexible portion and less flexible portion, which includes at least a substantial portion of the nose along the opposite edge, the more flexible portion being comparatively softer and the less flexible portion being comparatively harder, in Shore Durometer values.

16. The drywall-trimming strip of claim 15 wherein the comparatively harder portion includes at least substantially all of the nose.

17. The drywall-trimming strip of claim 15 wherein each of the comparatively harder and comparatively softer portions includes a substantially equal portion of the nose.

18. The drywall-trimming strip of claim 15 wherein the comparatively softer portion includes the entire tabs.

19. The drywall-trimming strip of claim 15 wherein the comparatively softer portion is comprised of the juncture.

20. The drywall-trimming strip of any one claims 15 through 19 wherein the outer surface conforms substantially to an arcuate profile having a radius in a range from approximately ¼ inch to approximately ¾ inch.

21. The drywall-trimming strip of claim 20 wherein the outer surface conforms substantially to an arcuate profile having a radius in a range from approximately ¼ inch to approximately 17/32 inch.

22. The drywall-trimming strip of claim 15 made in its entirety from a uniform material.

23. The drywall-trimming strip of claim 22 wherein the material is substantially rigid.

* * * * *

UNITED STATES PATENT AND TRADEMARK OFFICE

CERTIFICATE OF CORRECTION

PATENT NO. : 6,119,420
DATED : September 19, 2000
INVENTOR(S) : Joseph M. Koenig, Jr.; Mark Budzik It is certified that error appears in the above-identified patent and that said Letters Patent is hereby corrected as shown below:

Claim 13,
Line 6, -- strip -- should be inserted after "drywall-trimming".

Claim 15,
Line 12, -- a -- should be inserted after "having" and -- a -- should be inserted after "less".

Signed and Sealed this

Twenty-third Day of October, 2001

*Attest:*

Nicholas P. Godici

NICHOLAS P. GODICI
*Acting Director of the United States Patent and Trademark Office*

*Attesting Officer*